US009240275B2

(12) United States Patent
Inubushi et al.

(10) Patent No.: US 9,240,275 B2
(45) Date of Patent: Jan. 19, 2016

(54) CORE FOR A WIRE-WOUND ELECTRONIC COMPONENT, A WIRE-WOUND ELECTRONIC COMPONENT AND A METHOD FOR MANUFACTURING A CORE FOR A WIRE-WOUND ELECTRONIC COMPONENT

(71) Applicant: MURATA MANUFACTURING CO., LTD., Kyoto (JP)

(72) Inventors: Toshikazu Inubushi, Kyoto-fu (JP); Osamu Monguchi, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 14/090,976

(22) Filed: Nov. 26, 2013

(65) Prior Publication Data

US 2015/0028985 A1 Jan. 29, 2015

Related U.S. Application Data

(60) Provisional application No. 61/859,667, filed on Jul. 29, 2013.

(51) Int. Cl.

| | |
|---|---|
| ***H01F 27/02*** | (2006.01) |
| ***B21F 3/04*** | (2006.01) |
| ***B27N 3/18*** | (2006.01) |
| ***H01F 27/30*** | (2006.01) |
| ***H01F 41/02*** | (2006.01) |
| ***H01F 17/04*** | (2006.01) |
| *H01F 27/29* | (2006.01) |

(52) U.S. Cl.

CPC ..... *H01F 27/306* (2013.01); *H01F 17/04* (2013.01); *H01F 41/0246* (2013.01); *H01F 27/292* (2013.01)

(58) Field of Classification Search

CPC ..... H01F 17/045; H01F 17/04; H01F 27/24; H01F 24/306; H01F 41/0246; H01F 41/0612; H01F 27/292; H01F 27/2823; H01F 14/04

USPC ..... 336/83; 242/437; 264/319

See application file for complete search history.

(56) References Cited

U.S. PATENT DOCUMENTS

| | | | | |
|---|---|---|---|---|
| 6,242,996 | B1 * | 6/2001 | Sato et al. | 336/200 |
| 2009/0195342 | A1 * | 8/2009 | Azuma et al. | 336/192 |
| 2011/0267167 | A1 * | 11/2011 | Ogawa et al. | 336/221 |
| 2013/0154784 | A1 * | 6/2013 | Hachiya et al. | 336/200 |

FOREIGN PATENT DOCUMENTS

| | | | |
|---|---|---|---|
| JP | 11-251150 | A | 9/1999 |
| JP | 2001-267138 | A | 9/2001 |

(Continued)

*Primary Examiner* — Mangtin Lian

(74) *Attorney, Agent, or Firm* — Studebaker & Brackett PC

(57) ABSTRACT

A wire-wound electronic component, a core for a wire-wound electronic component and a method for manufacturing a core for a wire-wound electronic component are provided. A winding core portion of a core of a wire-wound electronic component includes flanges at respective ends of the winding core portion, and project in directions perpendicular to an axial direction of the winding core portion. Concaves are positioned at corners formed of adjoining surfaces of the flanges that adjoin to the winding core portion and end surfaces of the flanges that are located at ends in a first perpendicular direction, which is one of the projecting directions of the flange. Connecting surfaces, which connect contact portions where the flanges contact with the winding core portion to the end surfaces, are at least part of inner peripheries of the concaves. All normal vectors of the connecting surfaces have components in the first perpendicular direction.

14 Claims, 12 Drawing Sheets

(56) References Cited

FOREIGN PATENT DOCUMENTS

| | | | |
|---|---|---|---|
| JP | 2002-313646 | A | 10/2002 |
| JP | 2006-032818 | A | 2/2006 |
| JP | 2007-273725 | A | 10/2007 |
| JP | 2011-171544 | A | 9/2011 |

* cited by examiner

CORE FOR A WIRE-WOUND ELECTRONIC COMPONENT, A WIRE-WOUND ELECTRONIC COMPONENT AND A METHOD FOR MANUFACTURING A CORE FOR A WIRE-WOUND ELECTRONIC COMPONENT

CROSS REFERENCE TO RELATED APPLICATIONS

The present application claims priority to U.S. Provisional Application No. 61/859,667 filed on Jul. 29, 2013, the entire content of which is incorporated herein by reference.

TECHNICAL FIELD

The technical field relates to a core for a wire-wound electronic component, a wire-wound electronic component and a method for manufacturing a core for a wire-wound electronic component.

BACKGROUND

As a conventional core for a wire-wound electronic component, for example, a core of a wire-wound coil component disclosed by Japanese Patent Laid-Open Publication No. 2011-171544 (Patent Document 1) is known. Hereinafter, the wire-wound coil component 500 disclosed by Patent Document 1 is described. FIG. 22 is a sectional view of the wire-wound coil component 500 disclosed by Patent Document 1. FIG. 23 is a sectional view of the wire-wound coil component 500 disclosed by Patent Document 1 in the middle of a production process. FIG. 24 is a sectional view of a wire-wound coil component 500' disclosed by Patent Document 1 in consideration of a manufacturing method of the wire-wound coil component 500. FIG. 25 is a sectional view of the wire-wound coil component 500' in the middle of a production process. In FIGS. 22 and 23, a direction along the central axis of a winding core portion 501*a* of the wire-wound coil component 500' is defined as an x-axis. In FIGS. 23 and 25, a direction in which molding dies to press magnetic cores 501 and 501' are pulled away is defined as a y-axis.

As shown by FIG. 22, the wire-wound coil component 500 comprises a magnetic core 501, external electrodes 512*a* and 512*b*, and a winding wire 513. The magnetic core 501 is made of an insulating material, and comprises a winding core portion 501*a*, and flanges 501*b* and 501*c*. The winding core portion 501*a* extends in the x-axis direction. The flanges 501*b* and 501*c* are disposed at both ends of the winding core portion 501*a*.

The external electrodes 512*a* and 512*b* are provided on the flanges 501*b* and 501*c*, respectively. A winding wire 513 is wound around the winding core portion 501*a*, and both ends of the winding wire 513 are connected to the external electrodes 512*a* and 512*b*, respectively.

In the magnetic core 501 of the wire-wound coil component 500 structured as thus far described, the flanges 501*b* and 501*c* protrude from the winding core portion in a direction perpendicular to the x-axis direction, as shown by FIG. 22. Thereby, the flanges 501*b* and 501*c* protect the portion where the winding wire 513 is wound around the winding core portion 501*a* from heat radiated from a thermo-compression bonding device while the external electrodes 512 and the winding wire 513 are connected.

However, the existence of the flanges 501*b* and 501*c* is a cause of chips or cracks in the magnetic core 501 that break out during a production process of the magnetic core 501. The flanges 501*b* and 501*c* are molded by filling powder of the material of the core in a female die, and by pressing the filled powder with male dies 550 and 560 as shown by FIG. 23. However, if side surfaces S501 to S504 of the flanges 501*b* and 501*c* are parallel to the pull-away direction, frictions between the side surfaces S501 to S504 and side surfaces S509 to S512 of the male dies 550 and 560 occur during the pull-away process after the pressing process. Consequently, the magnetic core 501 may have chips or cracks.

For the reason above, the magnetic core 501 of the wire-wound coil component 500 shown by FIG. 22 actually, at both ends of the winding core portion 501*a* in the x-axis direction, has taper surfaces S501' to S504' tapering from the winding core portion 501*a* toward end surfaces S505 to S508 of the flanges as shown by FIG. 24. Thereby, at the same time as the molding-die pull-away process starts, the side surfaces S509' to S512' of the male dies separate from the taper surfaces S501' to S504'. Accordingly, the frictions between the taper surfaces S501' to S504' and the side surfaces S509' to S512' of the male dies are suppressed, and occurrence of chips or cracks in the magnetic core 501' can be suppressed.

However, as shown in FIG. 24, since the taper surfaces are disposed at both ends of the winding core portion 501*a* in the x-axis direction, the area of the magnetic core 501' used for winding of the wire is reduced. Accordingly, the number of turns or the diameter of the winding wire 513 are limited, which prevents improvement in inductance.

SUMMARY

The present disclosure provides a core for a wire-wound electronic component, a wire-wound electronic component and a method for manufacturing a core for a wire-wound electronic component that prevent chips or cracks in the core from breaking out during molding of the core for a wire-wound electronic component and that permit a winding core portion of the core for a wire-wound electronic component to have a winding area extended to the ends of the winding core portion.

A core for a wire-wound electronic component according to the present disclosure comprises a winding core portion around which a winding wire is to be wound, and flanges provided at respective ends of the winding core portion. The flanges project from the winding core portion in directions perpendicular to an axial direction of the winding core portion. Concaves are provided at respective corners, where each corner is formed of an adjoining surface of one of the flanges that adjoins to the winding core portion and an end surface of the flange that is located at an end in a first perpendicular direction, which is one of the projecting directions of the flanges. At least part of inner periphery of each of the concaves includes a connecting surface that connects a contact portion where one of the flanges contact with the winding core portion to one of the end surfaces, and all normal vectors of the connecting surfaces have components in the first perpendicular direction.

In another embodiment, a wire-wound electronic component may include the above-described core for a wire-wound electronic component, and a winding wire that is wound around the winding core portion of the core.

A method for manufacturing a core for a wire-wound electronic component according to an embodiment of the present disclosure is a method for manufacturing a core for a wire-wound electronic component comprising a winding core portion, and flanges that are provided at respective ends of the winding core portion and project in directions perpendicular to an axial direction of the winding core portion, and the method comprises a first step of filling a material of the core in a female die and a second step of pressing the material of the core filled in the female die with a male die. In the second step, connecting surfaces that respectively connect a contact portion where one of the flanges contact with the winding core portion to a respective end surface that is located at an end in the projecting direction of the flanges are, respectively, at least part of an inner periphery of a concave at a respective corners, each corner formed of an adjoining surface of one of the flanges that adjoins to the winding core portion and one of the end surfaces. All normal vectors of first pressing surfaces of the male die to press the connecting surfaces have components in a direction opposite to a molding-die pull-away direction.

DETAILED DESCRIPTION

A wire-wound electronic component, a core for a wire-wound electronic component, and a method for manufacturing a wire-wound electronic component according to the present disclosure are hereinafter described.

Figure 1:
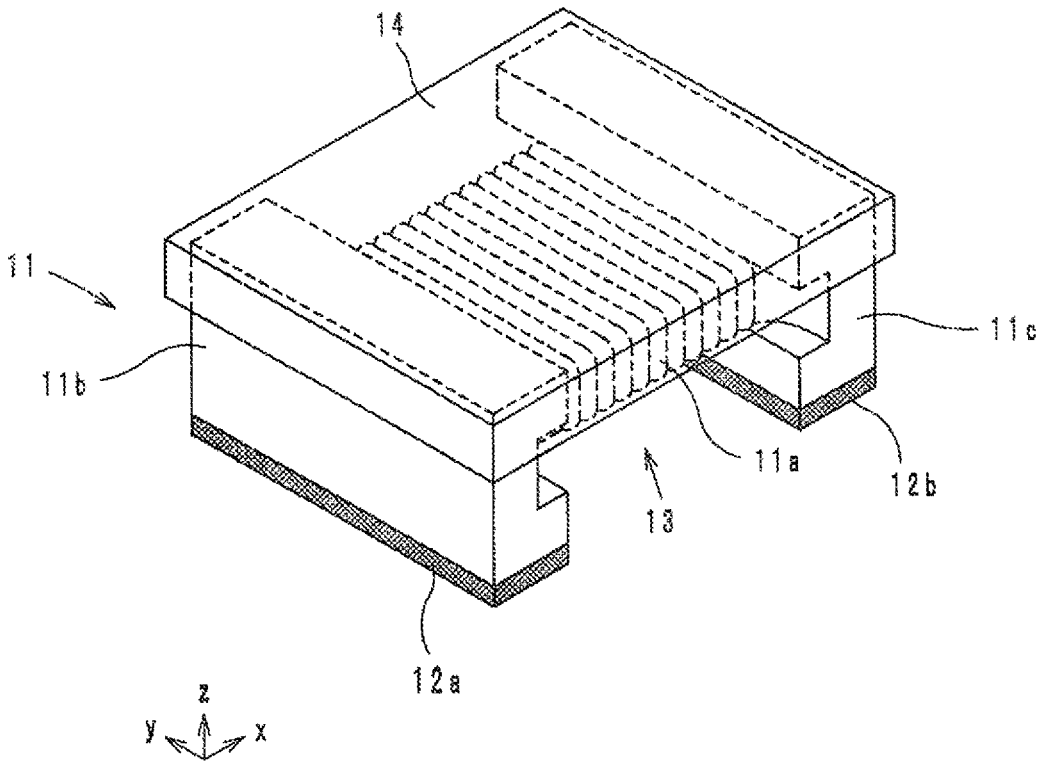
FIG. 1 is a perspective view of a wire-wound electronic component according to an exemplary embodiment.
Figure 2:
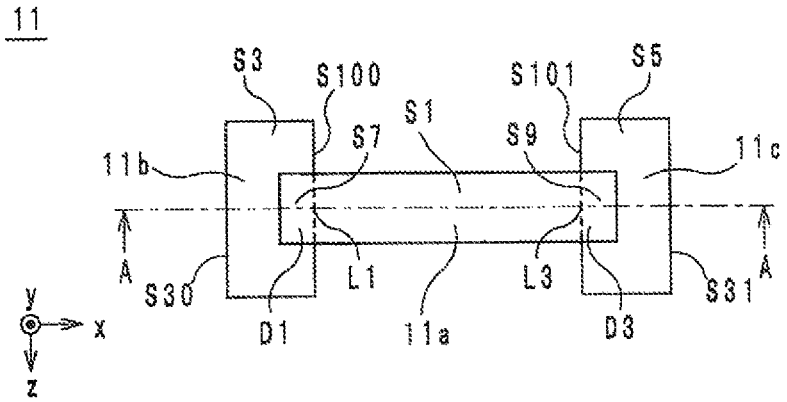
FIG. 2 is a plan view of a core of the wire-wound electronic component according to the exemplary embodiment, when viewed from a positive side on a y-axis direction.
Figure 3:
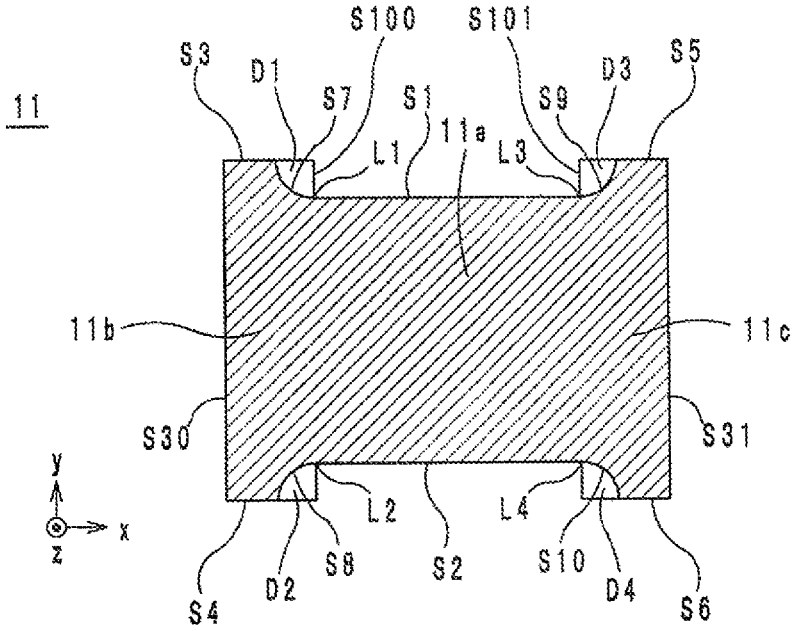
FIG. 3 is a sectional view of the core of the wire-wound electronic component shown by FIG. 2, taken along the line A-A.
Figure 4:
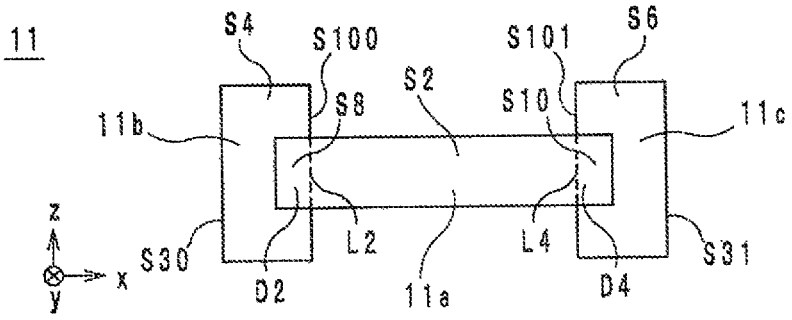
FIG. 4 is a plan view of the core of the wire-wound electronic component shown by FIG. 2, when viewed from a negative side on the y-axis direction.
Figure 5:
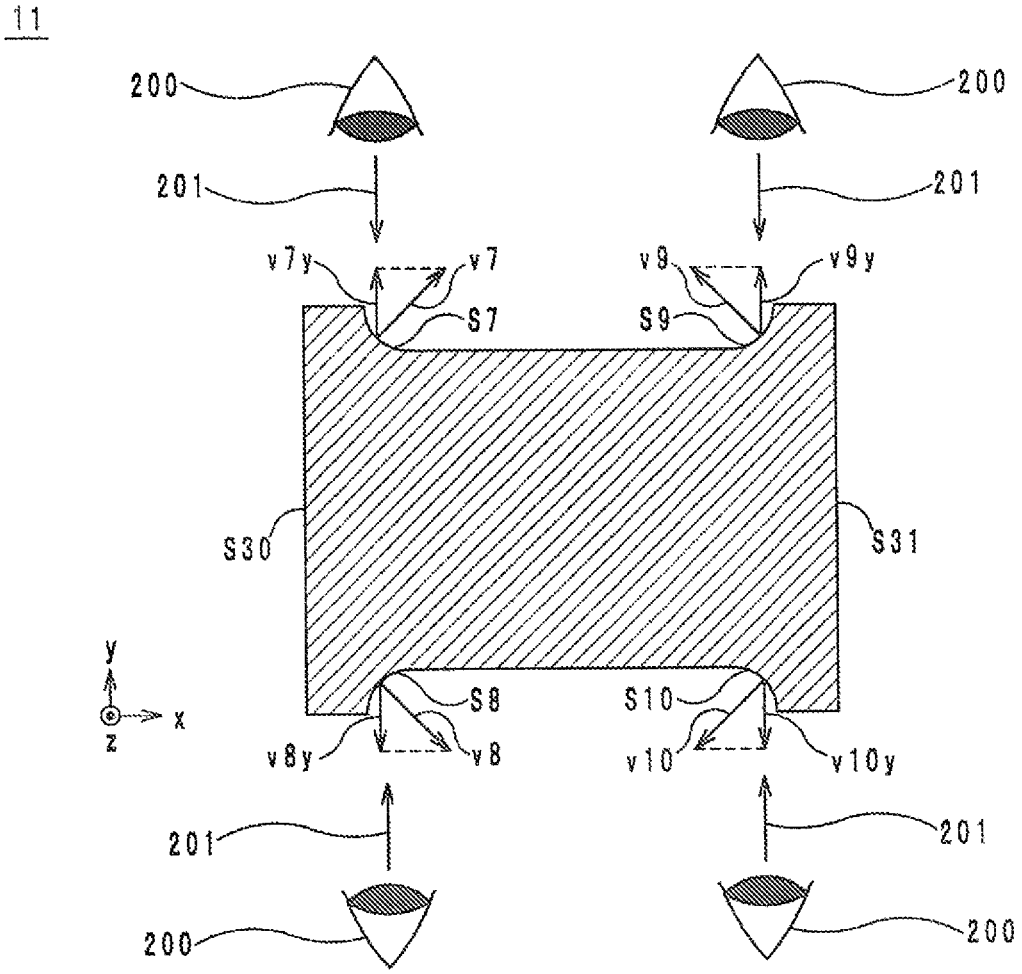
FIG. 5 is a sectional view of the core of the wire-wound electronic component shown by FIG. 2, taken along the line A-A.

Structure of the Wire-Wound Electronic Component: The structure of a wire-wound electronic component 10 according to an exemplary embodiment of the present disclosure will now be described. FIG. 1 is a perspective view of the wire-wound electronic component 10 according to the exemplary embodiment. FIG. 2 is a plan view of a core 11 of the wire-wound electronic component 10 according to the exemplary embodiment, when viewed from a positive side on the y-axis direction. FIGS. 3 and 5 are sectional views of the core 11 of the wire-wound electronic component 10, taken along the line A-A. FIG. 4 is a plan view of the core 11 of the wire-wound electronic component 10 according to the exemplary embodiment, when viewed from a negative side on the y-axis direction. In FIGS. 1 to 5, a direction in which the central axis of a winding core portion extends is defined as an x-axis. Directions along two sides of an end surface located at an end of the core 11 on the x-axis are defined as a y-axis and a z-axis, respectively. The x-axis, the y-axis and the z-axis are perpendicular to one another.

As shown by FIG. 1, the wire-wound electronic component 10 comprises a core 11, electrodes 12*a* and 12*b*, a winding wire 13, and a protective member 14. The core 11 is made of an insulating material, such as ferrite, alumina or the like, and the core 11 comprises a winding core portion 11*a* (hidden by the winding wire 13 in FIG. 11), and flanges 11*b* and 11*c*.

As shown by FIGS. 1 to 4, the winding core portion 11*a* is a member that is in the shape of a cuboid extending in the x-axis direction. However, the winding core portion 11*a* does not need to be prismatic, and may be cylindrical or polygonal. As shown in FIG. 3, a surface located at a positive end of the winding core portion 11*a* on the y-axis direction is referred to as an end surface S1, and a surface located at a negative end of the winding core portion 11*a* on the y-axis direction is referred to as an end surface S2. Ends of the winding core portion 11*a* on the x-axis direction correspond to "both ends of the winding core portion" according to the present disclosure.

The flange 11*b*, as shown in FIGS. 1 to 4, is disposed at a negative end of the winding core portion 11*a* on the x-axis direction. The flange 11*c* is disposed at a positive end of the winding core portion 11*a* on the x-axis direction. Each of the flanges 11*b* and 11*c* is a substantial cuboid part protruding from the winding core portion in the y-axis direction and in the z-axis direction. The flange 11*b* is symmetrical with the flange 11*c* with respect to a plane that passes the middle point of the winding core portion 11*a* on the x-axis direction and that is in parallel to the y-axis and the z-axis.

As shown in FIG. 3, a surface located at a positive end of the flange 11*b* on the y-axis direction (i.e., a surface located at an end on a first perpendicular direction that is one of the protruding directions of the flanges) is referred to as an end surface S3. A surface located at a negative end of the flange 11*b* on the y-axis direction (i.e., a surface located at an end on the first perpendicular direction that is one of the protruding directions of the flanges) is referred to as an end surface S4. The end surface S4 is symmetrical with the end surface S3 with respect to a plane that passes the middle point of the winding core portion 11*a* on the y-axis direction and that is in parallel to the y-axis and the z-axis. Further, as shown in FIGS. 2 and 3, a surface that is located at a positive end of the flange 11*b* on the x-axis direction and that is adjoining the winding core portion 11*a* is referred to as an adjoining surface S100.

As shown in FIG. 3, a surface located at a positive end of the flange 11*c* on the y-axis direction (i.e., a surface located at an end on the first perpendicular direction that is one of the protruding directions of the flanges) is referred to as an end surface S5. A surface located at a negative end of the flange 11*c* on the y-axis direction (i.e., a surface located at an end on the first perpendicular direction that is one of the protruding directions of the flanges) is referred to as an end surface S6. The end surface S6 is symmetrical with the end surface S5 with respect to a plane that passes the middle point of the winding core portion 11*a* on the y-axis direction and that is in parallel to the y-axis and the z-axis. Further, as shown in FIGS. 2 and 3, a surface that is located at a negative end of the flange 11*c* on the x-axis direction and that is adjoining the winding core portion 11*a* is referred to as an adjoining surface S101.

As shown in FIGS. 2 and 3, a concave D1 is made at an intermediate position, in the z-axis direction, of the corner of the flange 11*b* located at the positive side on the x-axis direction and at the positive side on the y-axis direction, that is, of the corner formed by the adjoining surface S100 and the end surface S3. Within the inner periphery of the concave surface D1, a surface connecting a contact portion L1, where the end surface S1 contacts with the flange 11*b*, to the end surface S3 is referred to as a connecting surface S7.

As shown in FIG. 5, the y-axis direction component v7*y* of a normal vector v7, which is one of the normal vectors of the connecting surface S7, is positive. Further, the y-axis direction components of the other normal vectors of the connecting surface S7 are positive. The positive direction along the y-axis is one of the protruding directions of the flange 11*b* (i.e., the first perpendicular direction). Thus, all of the normal vectors of the connecting surface S7 have components in the protruding direction of the flange 11*b* (i.e., the first perpendicular direction). The positive direction along the y-axis is a molding-die pull-away direction in which a male die 50 is pulled away, as will be described later.

All of the normal vectors of the connecting surface S7 have components in the protruding direction of the flange 11*b* (i.e., the first perpendicular direction). Therefore, as shown in FIG. 5, the entire connecting surface S7 is visible from an eye 200 located at the positive side on the y-axis direction as shown by a visual line 201, that is, from a direction perpendicular to the axis of the winding core portion 11*a* (a specified direction). In other words, the connecting surface S7 is formed of visible surfaces.

Figure 6:
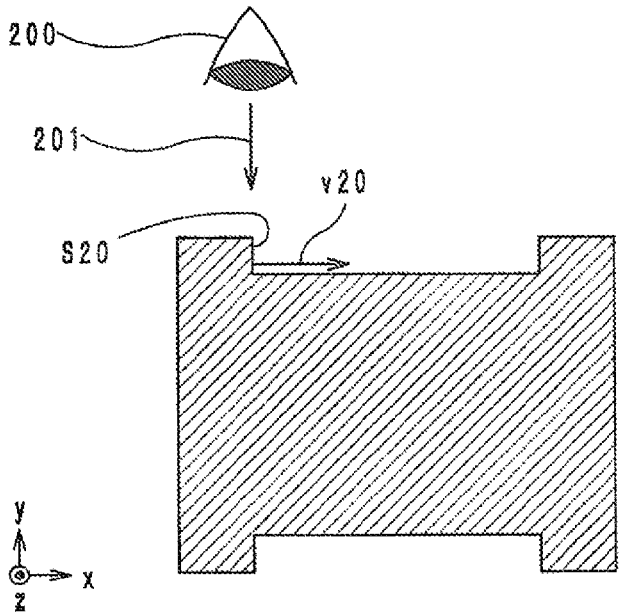
FIG. 6 is a sectional view of a core for a wire-wound electronic component that does not meet the requirements described in the present disclosure.

An example of a case in which the connecting surface is invisible is shown by FIG. 6. A normal vector v20 of a connecting surface S20 shown in FIG. 6 does not have a component in the protruding direction of the flange 11*b* from the winding core portion 11*a*, that is, in the direction perpendicular to the axis of the winding core portion 11*a* (i.e., the specified direction). Thus, the connecting surface S20 is an invisible surface from an eye 200 located at the positive side on the y-axis direction as shown by a visual line 201.

As shown in FIGS. 3 and 4, a concave D2 is made at an intermediate position, in the z-axis direction, of the corner of the flange 11*b* located at the positive side on the x-axis direction and at the negative side on the y-axis direction, that is, of the corner formed by the adjoining surface S100 and the end surface S4. Within the inner periphery of the concave surface D2, a surface connecting a contact portion L2, where the end surface S2 contacts with the flange 11*b*, to the end surface S4 is referred to as a connecting surface S8.

As shown in FIG. 5, the y-axis direction component v8*y* of a normal vector v8, which is one of the normal vectors of the connecting surface S8, is negative. Further, y-axis direction components of the other normal vectors of the connecting surface S8 are negative. The negative direction along the y-axis is one of the protruding directions of the flange 11*b* (i.e., the first perpendicular direction). Thus, all of the normal vectors of the connecting surface S8 have components in the protruding direction of the flange 11*b* (i.e., the first perpendicular direction). The negative direction along the y-axis is a molding-die pull-away direction in which a male die 60 is pulled away, as will be described later.

All of the normal vectors of the connecting surface S8 have components in the protruding direction of the flange 11*b* (i.e., the first perpendicular direction). Therefore, as shown in FIG. 5, the entire connecting surface S8 is visible from an eye 201 located at the negative side on the y-axis direction as shown by a visual line 201, that is, from a direction perpendicular to the axis of the winding core portion 11*a* (i.e., the specified direction). In other words, the connecting surface S8 is formed of visible surfaces.

As shown in FIGS. 2 and 3, a concave D3 is made at an intermediate position, in the z-axis direction, of the corner of the flange 11*c* located at the negative side on the x-axis direction and at the positive side on the y-axis direction, that is, of the corner formed by the adjoining surface S101 and the end surface S5. Within the concave surface D3, a surface connecting a contact portion L3, where the end surface S1 contacts with the flange 11*c*, to the end surface S5 is referred to as a connecting surface S9.

As shown in FIG. 5, the y-axis direction component v9*y* of a normal vector v9, which is one of the normal vectors of the connecting surface S9, is positive. Further, the y-axis direction components of the other normal vectors of the connecting surface S9 are positive. The positive direction along the y-axis is one of the protruding directions of the flange 11*c* (i.e., the first perpendicular direction). Thus, all of the normal vectors of the connecting surface S9 have components in the protruding direction of the flange 11*c* (i.e., the first perpendicular direction). The positive direction along the y-axis is the molding-die pull-away direction in which the male die 50 is pulled away, as will be described later.

All of the normal vectors of the connecting surface S9 have components in the protruding direction of the flange 11*c* (i.e., the first perpendicular direction). Therefore, as shown in FIG. 5, the entire connecting surface S9 is visible from an eye 200 located at the positive side on the y-axis direction as shown by a visual line 201, that is, from the direction perpendicular to the axis of the winding core portion 11*a* (i.e., the specified direction). In other words, the connecting surface S9 is formed of visible surfaces.

As shown in FIGS. 3 and 4, a concave D4 is made at an intermediate position, in the z-axis direction, of the corner of the flange 11*c* located at the negative side on the x-axis direction and at the negative side on the y-axis direction, that is, of the corner formed by the adjoining surface S101 and the end surface S6. Within the concave surface D4, a surface connecting a contact portion L4, where the end surface S2 contacts with the flange 11*c*, to the end surface S6 is referred to as a connecting surface S10.

As shown in FIG. 5, the y-axis direction component v10*y* of a normal vector v10, which is one of the normal vectors of the connecting surface S10, is negative. Further, the y-axis direction components of the other normal vectors of the connecting surface S10 are negative. The negative direction along the y-axis is one of the protruding directions of the flange 11*c* (i.e., the first perpendicular direction). Thus, all of the normal vectors of the connecting surface S9 have components in the protruding direction of the flange 11*c* (i.e., the first perpendicular direction). The negative direction along the y-axis is the molding-die pull-away direction in which the male die 60 is pulled away, as will be described later.

All of the normal vectors of the connecting surface S10 have components in the protruding direction of the flange 11*c* (i.e., the first perpendicular direction). Therefore, as shown in FIG. 5, the entire connecting surface S10 is visible from an eye 200 located at the negative side on the y-axis direction as shown by a visual line 201, that is, from the direction perpendicular to the axis of the winding core portion 11*a* (i.e., the specified direction). In other words, the connecting surface S10 is formed of visible surfaces.

As shown in FIGS. 2 and 4, the widths of the connecting surfaces S7 to S10 in the z-axis direction are substantially equal to the widths of the end surfaces S1 and S2 in the z-axis direction. The connecting surfaces S7 to S10, as shown in FIGS. 2 and 4, extend in the same direction as the x-axis direction, which is the direction in which the winding core portion 11*a* extends.

As shown in FIG. 3, the sections of the connecting surfaces S7 to S10 viewed from the z-axis direction are arcs. Therefore, the connecting surface S7 is shaped such that with increasing distance from the contact portion L1 and decreasing distance to a main surface S30 of the flange 11*b* that is opposite to the adjoining surface S100 and is situated in the axial direction of the winding core portion 11*a* to the contact portion L1, that is, as it comes farther in the negative side on the x-axis direction from the contact portion L1, the distance in the y-axis direction between the connecting surface S7 and the end surface S3 decreases. The connecting surface S8 is shaped such that with increasing distance from the contact portion L2 and decreasing distance to the main surface S30 of the flange 11*b* that is opposite to the adjoining surface S100 and is situated in the axial direction of the winding core portion 11*a* to the contact portion L2, that is, as it comes farther in the negative side on the x-axis direction from the contact portion L2, the distance in the y-axis direction between the connecting surface S8 and the end surface S4 decreases. The connecting surface S9 is shaped such that with increasing distance from the contact portion L3 and decreasing distance to a main surface S31 of the flange 11*c* that is opposite to the adjoining surface S101 and is situated in the axial direction of the winding core portion 11*a* to the contact portion L3, that is, as it comes farther in the positive side on the x-axis direction from the contact portion L3, the distance in the y-axis direction between the connecting surface S9 and the end surface S5 decreases. The connecting surface S10 is shaped such that with increasing distance from the contact portion L4 and decreasing distance from the main surface S31 of the flange 11*c* that is opposite to the adjoining surface S101 and is situated in the axial direction of the winding core portion 11*a* to the contact portion L4, that is, as it comes farther in the positive side on the x-axis direction from the contact portion L4, the distance in the y-axis direction between the connecting surface S10 and the end surface S6 decreases.

The x-axis direction corresponds to an "axial direction" according to the present disclosure. The y-axis direction corresponds to a "first perpendicular direction" according to the present disclosure. The z-axis direction corresponds to a "second perpendicular direction" according to the present disclosure.

Also, the y-axis direction corresponds to a "specified direction" according to the present disclosure. The z-axis direction corresponds to a "perpendicular direction" according to the present disclosure.

The electrodes 12*a* and 12*b* are made of, for example a nickel alloy, such as Ni—Cr, Ni—Cu and Ni, Ag, Cu, Sn, etc. The electrode 12*a*, as shown in FIG. 1, is provided on an end surface located at a negative side on the z-axis direction (on a first end surface) of the flange 11*b*, and the electrode 12*b*, as shown in FIG. 1, is provided on an end surface located at the negative side on the z-axis direction (on the second perpendicular direction) of the flange 11*c*. When the wire-wound electronic component 10 is mounted on a circuit board, the electrodes 12*a* and 12*b* are electrically connected to electrodes of the circuit board via a solder or the like.

The winding wire 13, as shown in FIG. 1, is wound around the winding core portion 11*a*. Both ends of the winding wire 13 are connected to the electrodes 12*a* and 12*b*, respectively.

The protective member 14 is composed of a resin composition, such as epoxy resin, for example. The protective member 14 is placed on the surface of the core 11 at the positive side on the z-axis direction to cover the winding wire 13 and the flanges 11*b* and 11*c* entirely.

Figure 7:
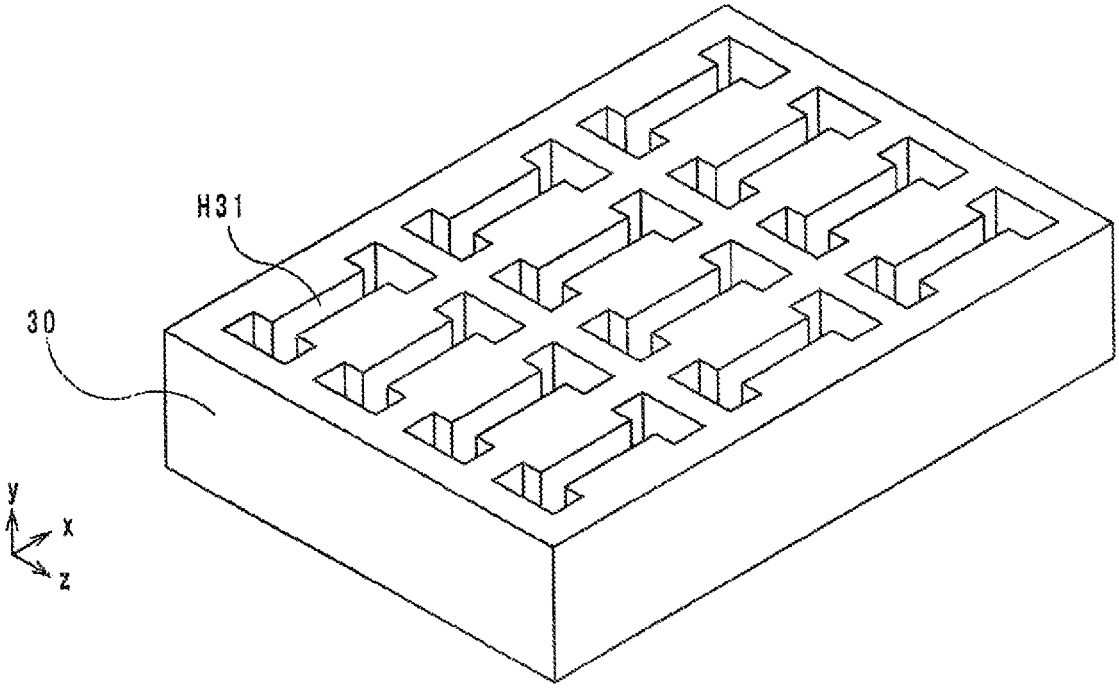
FIG. 7 is a perspective view of a female die for molding the core of the wire-wound electronic component according to the exemplary embodiment.
Figure 8:
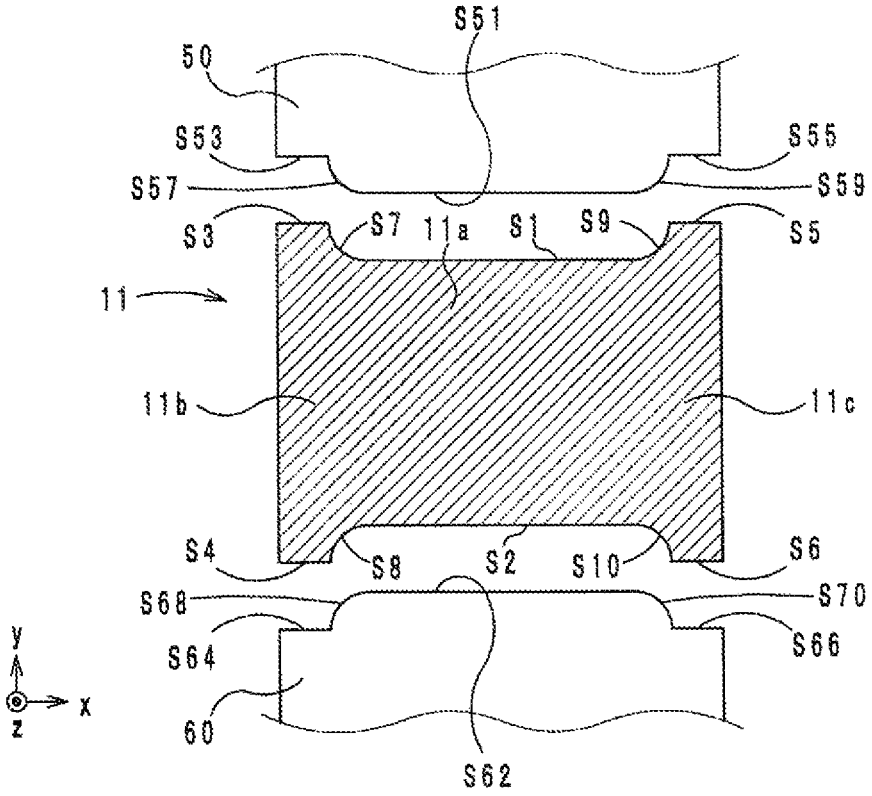
FIG. 8 is a sectional view of the core of the wire-wound electronic component during a production process according to the exemplary embodiment.

Manufacturing Method of the Wire-Wound Electronic Component: A manufacturing method of the wire-wound electronic component 10 is hereinafter described with reference to the accompanying drawings. FIG. 7 is a perspective view of a female die 30 for manufacturing the cores 11 of the wire-wound electronic components. FIG. 8 is a sectional view showing a molding-die pull-away process of separating the male dies 50 and 60 after pressing of the core material filled in the female die 30 with the male dies 50 and 60. In FIGS. 7 and 8, an axis corresponding to the extending direction of the central axis of the winding core portion 11*a* of the core 11 is defined as an x-axis. An axis corresponding to the molding-die pull-away direction in which the male dies are pulled is defined as a y-axis. A normal of a plane including the x-axis and the y-axis is defined as a z-axis.

First, powder of a ferrite-based material, which is the material of the core 11, is prepared. Next, the prepared ferrite powder is filled in through-holes H31 of the female die 30 shown by FIG. 7. The through-holes H31 pierce the female die 30 in the y-axis direction. The through-holes H31 are arranged in a matrix in the female die 30. Each of the through-holes H31, when viewed from the y-axis direction, is substantially in the shape of an H, as shown by FIGS. 2 and 4.

Next, as shown by FIG. 8, the filled powder is pressed with the male dies 50 and 60, whereby cores 11 are molded. More specifically, the male dies 50 and 60 are opposed to each other in the y-axis direction via the female die 30. The male die 50 presses the powder filled in the female die 30 from the positive side to the negative side in the y-axis direction. At the same time as the male die 50 presses the powder, the male die 60 presses the powder filled in the female die 50 from the negative side to the positive side in the y-axis direction. The pressing is carried out only once. The density of the molded cores 11 is adjusted by adjusting the quantity of the ferrite powder filled in the female die and the pressing degree.

Pressing surfaces S51, S53, S55, S57 and S59 of the male die 50, which are used for the pressing, are formed into the shapes corresponding to the core 11 shown by FIG. 3. More specifically, as shown in FIG. 8, the pressing surface S51 corresponds to the end surface S1 of the winding core portion 11*a*. The pressing surface S53 corresponds to the end surface S3 of the flange 11*b*. The pressing surface S55 corresponds to the end surface S5 of the flange 11*c*. Accordingly, the pressing surfaces S53, S51 and S55 are arranged in this order from the negative side to the positive side on the x-axis direction. Since the end surfaces S3 and S5 are located farther in the positive side on the y-axis direction than the end surface S1, the pressing surfaces S53 and S55 are located farther in the positive side on the y-axis direction than the pressing surface S51. The pressing surface S57 (first pressing surface) corresponds to the connecting surface S7 of the flange 11*b*. Accordingly, the pressing surface S57 connects the pressing surface S51 and the pressing surface S53. The pressing surface S59 (first pressing surface) corresponds to the connecting surface S9 of the flange 11*c*. Accordingly, the pressing surface S59 connects the pressing surface S51 and the pressing surface S55.

Figure 9:
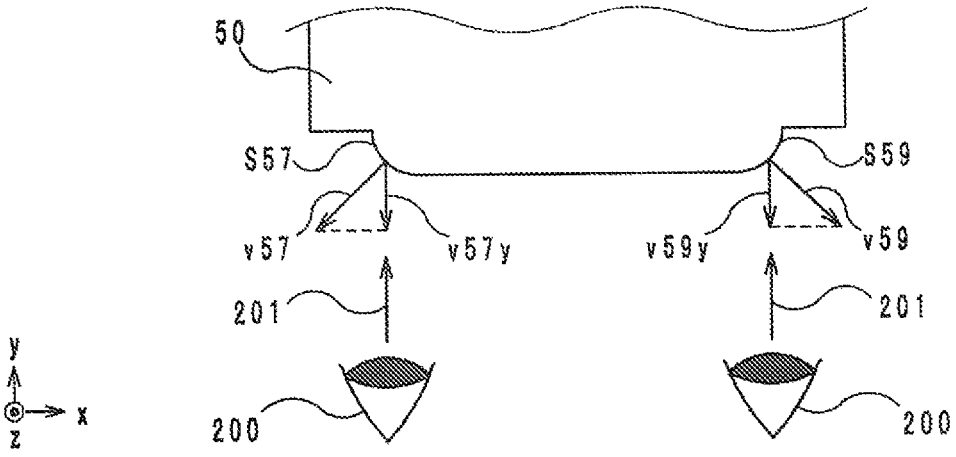
FIG. 9 is a sectional view of a male die for molding the core of the wire-wound electronic component according to the exemplary embodiment.

As shown in FIG. 9, the y-axis direction component v57*y* of a normal vector v57, which is one of the normal vectors of the pressing surface S57, is negative. Also, the y-axis direction components of the other normal vectors of the pressing surface S57 are negative. The negative direction along the y-axis is the opposite direction to the molding-die pull-away direction in which the male die 50 is pulled away. Thus, all of the normal vectors of the pressing surface S57 have components in the opposite direction to the molding-die pull-away direction in which the male die 50 is pulled away.

All of the normal vectors of the pressing surface S57 have components in the opposite direction to the molding-die pull-away direction in which the male die 50 is pulled away. Therefore, as shown in FIG. 9, the entire pressing surface S57 is visible from the molding-die pull-away direction of the male die 50. In other words, the pressing surface S57 is formed of visible surfaces from the molding-die pull-away direction of the male die 50.

As shown in FIG. 9, the y-axis direction component v59*y* of a normal vector v59, which is one of the normal vectors of the pressing surface S59, is negative. Also, the y-axis direction components of the other normal vectors of the pressing surface S59 are negative. The negative direction along the y-axis is the opposite direction to the molding-die pull-away direction in which the male die 50 is pulled away. Thus, all of the normal vectors of the pressing surface S59 have components in the opposite direction to the molding-die pull-away direction of the male die 50.

All of the normal vectors of the pressing surface S59 have components in the opposite direction to the molding-die pull-away direction in which the male die 50 is pulled away. Therefore, as shown in FIG. 9, the entire pressing surface S59 is visible from the pull-away direction of the male die 50. In other words, the pressing surface S59 is formed of visible surfaces from the molding-die pull-away direction of the male die 50.

Pressing surfaces S62, S64, S66, S68 and S70 of the male die 60 are formed into the shapes corresponding to the core 11 shown by FIG. 3. More specifically, as shown in FIG. 8, the pressing surface S62 corresponds to the end surface S2 of the winding core portion 11*a*. The pressing surface S64 corresponds to the end surface S4 of the flange 11*b*. The pressing surface S66 corresponds to the end surface S6 of the flange 11*c*. Accordingly, the pressing surfaces S64, S62 and S66 are arranged in this order from the negative side to the positive side on the x-axis direction. Since the end surfaces S4 and S6 are located farther in the negative side on the y-axis direction than the end surface S2, the pressing surfaces S64 and S66 are located farther in the negative side on the y-axis direction than the pressing surface S62. The pressing surface S68 (first pressing surface) corresponds to the connecting surface S8 of the flange 11*b*. Accordingly, the pressing surface S68 connects the pressing surface S62 and the pressing surface S64. The pressing surface S70 (first pressing surface) corresponds to the connecting surface S10 of the flange 11*c*. Accordingly, the pressing surface S70 connects the pressing surface S62 and the pressing surface S66.

Figure 10:
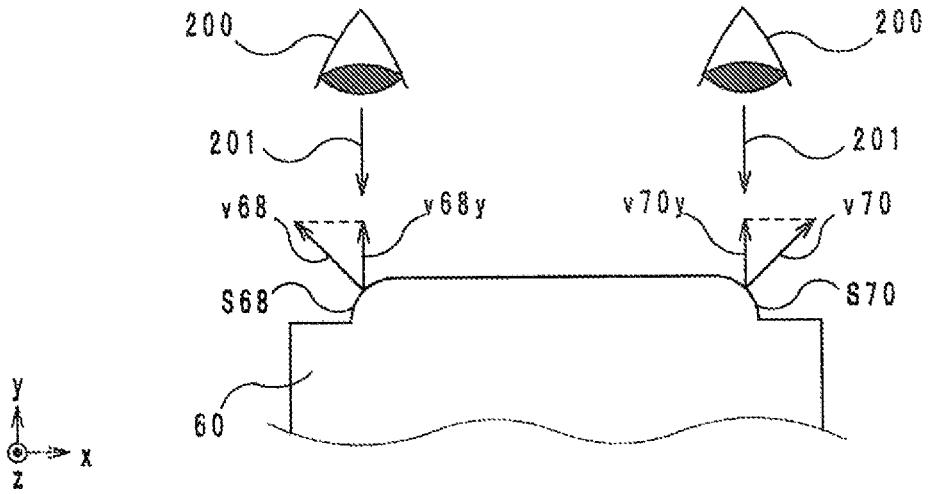
FIG. 10 is a sectional view of a male die for molding the core of the wire-wound electronic component according to the exemplary embodiment.

As shown in FIG. 10, the y-axis direction component v68*y* of a normal vector v68, which is one of the normal vectors of the pressing surface S68, is positive. Also, the y-axis direction components of the other normal vectors of the pressing surface S68 are positive. The positive direction along the y-axis is the opposite direction to the molding-die pull-away direction in which the male die 60 is pulled away. Thus, all of the normal vectors of the pressing surface S68 have components in the opposite direction to the molding-die pull-away direction of the male die 60.

All of the normal vectors of the pressing surface S68 have components in the opposite direction to the molding-die pull-away direction in which the male die 60 is pulled away. Therefore, as shown in FIG. 10, the entire pressing surface S68 is visible from the pull-away direction of the male die 60. In other words, the pressing surface S68 is formed of visible surfaces from the molding-die pull-away direction of the male die 60.

As shown in FIG. 10, the y-axis direction component v70*y* of a normal vector v70, which is one of the normal vectors of the pressing surface S70, is positive. Also, the y-axis direction components of the other normal vectors of the pressing surface S70 are positive. The positive direction along the y-axis is the opposite direction to the molding-die pull-away direction in which the male die 60 is pulled away. Thus, all of the normal vectors of the pressing surface S68 have components in the opposite direction to the molding-die pull-away direction of the male die 60.

All of the normal vectors of the pressing surface S70 have components in the opposite direction to the molding-die pull-away direction in which the male die 60 is pulled away. Therefore, the entire pressing surface S70 is visible from the pull-away direction of the male die 60. In other words, the pressing surface S70 is formed of visible surfaces from the molding-die pull-away direction of the male die 60.

Since the pressing surfaces S51, S57 and S59 correspond to the end surfaces S1, S7 and S9 of the core 11 shown in FIG. 2, respectively, the widths in the z-axis direction of the pressing surfaces S51, S57 and S59 are substantially equal to one another. Also, since the pressing surfaces S62, S68 and S70 correspond to the end surfaces S2, S8 and S10 of the core 11 shown in FIG. 4 respectively, the widths in the z-axis direction of the pressing surfaces S62, S68 and S70 are substantially equal to one another.

Since the pressing surfaces S51, S57 and S59 correspond to the end surfaces S1, S7 and S9 of the core 11 shown in FIG. 2, respectively, these pressing surfaces S51, S57 and S59 extend in the x-axis direction in which the central axis of the winding core portion 11*a* extends. Also, since the pressing surfaces S62, S68 and S70 correspond to the end surfaces S2, S8 and S10 of the core 11 shown in FIG. 4, respectively, these pressing surfaces S62, S68 and S70 extend in the x-axis direction in which the central axis of the winding core portion 11*a* extends.

As shown in FIG. 8, sections of the pressing surfaces S57, S59, S68 and S70 viewed from the z-axis direction are arcs. Accordingly, the pressing surface S57 is shaped such that with increasing distance from the pressing surface S51 and decreasing distance to the pressing surface S53, that is, as it comes farther in the negative side on the x-axis direction from the pressing surface S51, the distance in the y-axis direction between the pressing surface S57 and the pressing surface S53 decreases. The pressing surface S59 is shaped such that with increasing distance from the pressing surface S51 and decreasing distance from the pressing surface S55, that is, as it comes farther in the positive side on the x-axis direction from the pressing surface S51, the distance in the y-axis direction between the pressing surface S59 and the pressing surface S55 decreases. The pressing surface S68 is shaped such that with increasing distance from the pressing surface S62 and decreasing distance from the pressing surface S64, that is, as it comes farther in the negative side on the x-axis direction from the pressing surface S62, the distance in the y-axis direction between the pressing surface S68 and the pressing surface S64 decreases. The pressing surface S70 is shaped such that with increasing distance from the pressing surface S62 and decreasing distance from the pressing surface S66, that is, as it comes farther in the positive side on the x-axis direction from the pressing surface S62, the distance in the y-axis direction between the pressing surface S70 and the pressing surface S66 decreases.

Next, after the pressing process, the core 11 is put out of the male dies and is fired. A tunnel furnace is used for the firing. The tunnel furnace is divided into a plurality of zones, and temperature control is carried out on a zone basis. For example, a predetermined zone is controlled to be kept at 1000 degrees C., and the core 11 spends one hour to pass through the zone. Thereafter, barrel polishing is carried out to remove burr caused during the firing of the core 11.

Next, on each of the flanges 11*b* and 11*c*, a film of a nickel alloy, such as Ni—Cr, Ni—Cu, Ni or the like, and a film of Ag, Cu, Sn or the like are formed via a mask in this order, whereby the electrodes 12*a* and 12*b* are formed. This is not the only way of forming the electrodes 12*a* and 12*b*, and baking, plating or the like can be used.

After the formation of the electrodes 12*a* and 12*b*, the wire 13 is wound around the winding core portion 11*a*. In this moment, both end portions, with a predetermined length, of the wire 13 are led out of the winding core portion 12. The led-out portions of the wire 13 are connected to the corresponding electrodes 12*a* and 12*b* by thermal compression bonding.

Next, the protective member 14 is applied by a dip method such that the surface that is opposite to the surface with the electrodes 12*a* and 12*b* thereon via the core 11, and the winding wire 13 is covered by the protective member 14. With drying and hardening of the protective member 14, the wire-wound electronic component 10 is completed.

Figure 24:
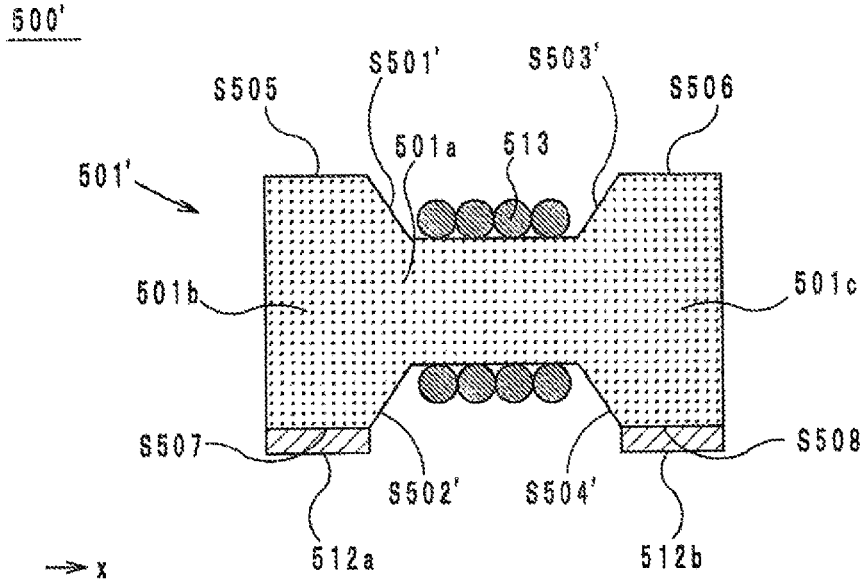
FIG. 24 Prior Art
FIG. 24 is a sectional view of a wire-wound coil component in consideration of a manufacturing method disclosed by Patent Document 1.
Figure 25:
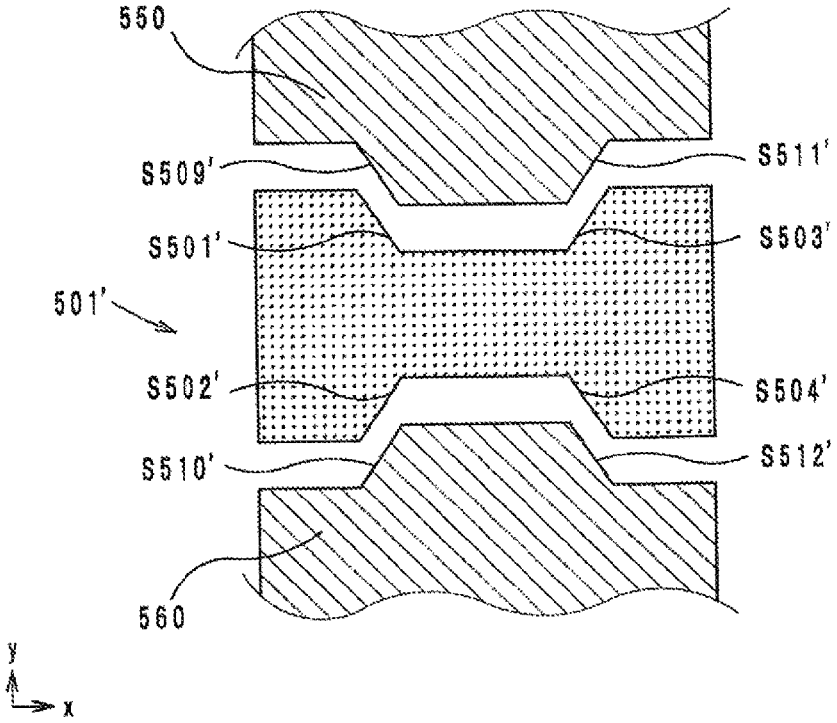
FIG. 25 Prior Art
FIG. 25 is a sectional view of the wire-wound coil component in consideration of the manufacturing method disclosed by Patent Document 1 during a production process.

Effects: In the wire-wound electronic component 10, instead of the tapering surfaces S501' to S504' provided at both ends of the winding core portion 501*a* as shown by FIG. 24, the concaves D1 to D4 are made in the flanges 11*b* and 11*c* as shown by FIG. 3. Every normal vector of each of the connecting surfaces S7 to S10, which are parts of the inner peripheries of the concave surfaces D1 to D4, has a component in the direction in which the flanges 11*b* and 11*c* protrude from the winding core portion 11*a* (i.e., in the first perpendicular direction). In other words, the connecting surfaces S7 to S10 are formed of visible surfaces when viewed from the y-axis direction, which is the molding-die pull-away direction. Hence, as shown by FIG. 8, at the same time as the molding-die pull-away process starts, the pressing surfaces S57, S59, S68 and S70 of the male dies 50 and 60 separate from the connecting surfaces S7 to S10 of the flanges 11*b* and 11*c*. Accordingly, the frictions between the pressing surfaces S57, S59, S68 and S70 of the male dies 50 and 60 and the connecting surfaces S7 to S10 of the flanges 11*b* and 11*c* can be suppressed, and the core 11 can be prevented from having chips or cracks.

In the wire-wound electronic component 10, as shown in FIGS. 2 to 4, the connecting surfaces S7 to S10 are provided to the flanges 11*b* and 11*c*, and the winding core portion 11*a* does not have tapering surfaces. Accordingly, in the wire-wound electronic component 10, the winding core portion 11*a* of the core 11 has a winding area, within which a wire can be wound around the winding core portion 11*a*, widened to the ends of the winding core portion 11*a*. Therefore, if wires with the same diameter are used as the winding wires in the wire-wound coil component 500' and in the wire-wound electronic component 10, the number of turns of the winding wire in the wire-wound electronic component 10 can be greater than the number of turns of the winding wire in the wire-wound coil component 500'. Accordingly, the inductance value of the wire-wound electronic component 10 can be greater than the inductance value of the wire-wound coil component 500'.

In the wire-wound electronic component 10, the winding area of the winding core portion 11*a* of the core 11 can be widened to the ends of the winding core portion 11*a*. Therefore, if the number of turns of the winding wire in the wire-wound coil component 500' and the number of turns of the winding wire in the wire-wound electronic component 10 are equal to each other, a wire with a greater diameter can be used in the wire-wound electronic component 10 than in the wire-wound coil component 500'. Accordingly, the resistance of the wire-wound electronic component 10 can be smaller than the resistance of the wire-wound coil component 500'.

In the wire-wound electronic component 10, as shown by FIG. 2, the end surface S1 of the winding core portion 11*a* and the connecting surfaces S7 and S9 of the flanges 11*b* and 11*c* of the core 11 are aligned in the x-axis direction. The widths in the z-axis direction of the end surface S1 of the winding core portion 11*a* and the connecting surfaces S7 and S9 of the flanges 11*b* and 11*c* are substantially equal to one another. Since the connecting surfaces S7 and S9 of the flanges 11*b* and 11*c* and the end surface S1 of the winding core portion 11*a* are aligned in a straight line as thus described, the male die 50 for pressing the core 11 of the wire-wound electronic component 10 has a simple shape.

In the wire-wound electronic component 10, as shown by FIG. 4, the end surface S2 of the winding core portion 11*a* and the connecting surfaces S8 and S10 of the flanges 11*b* and 11*c* of the core 11 are aligned in the x-axis direction. The widths in the z-axis direction of the end surface S2 of the winding core portion 11*a* and the connecting surfaces S8 and S10 of the flanges 11*b* and 11*c* are substantially equal to one another. Since the connecting surfaces S8 and S10 of the flanges 11*b* and 11*c* and the end surface S2 of the winding core portion 11*a* are aligned in a straight line as thus described, the male die 60 for pressing the core 11 of the wire-wound electronic component 10 has a simple shape.

In the wire-wound electronic component 10, as shown in FIG. 3, the connecting surface S7 of the core 11 is shaped such that as it comes farther in the negative side on the x-axis direction, the distance in the y-axis direction between the connecting surface S7 and the end surface S3 simply decreases. Also, the connecting surface S9 of the core 11 is shaped such that as it comes farther in the positive side on the x-axis direction, the distance in the y-axis direction between the connecting surface S9 and the end surface S5 simply decreases. That is, the connecting surfaces S7 and S9 do not have irregularities, and therefore, the male die 50 for pressing the core 11 of the wire-wound electronic component 10 has a simple shape.

In the wire-wound electronic component 10, further, as shown in FIG. 3, the connecting surface S8 of the core 11 is shaped such that as it comes farther in the negative side on the x-axis direction, the distance in the y-axis direction between the connecting surface S8 and the end surface S4 simply decreases. Also, the connecting surface S10 of the core 11 is shaped such that as it comes farther in the positive side on the x-axis direction, the distance in the y-axis direction between the connecting surface S10 and the end surface S6 simply decreases. That is, the connecting surfaces S8 and S10 do not have irregularities, and therefore, the male die 60 for pressing the core 11 of the wire-wound electronic component 10 has a simple shape.

Figure 11:
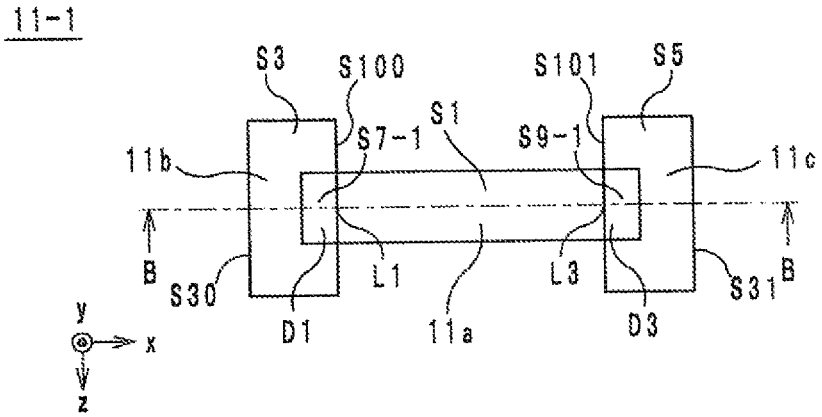
FIG. 11 is a plan view of a core of a wire-wound electronic component according to a first exemplary modification, when viewed from a positive side on the y-axis direction.
Figure 12:
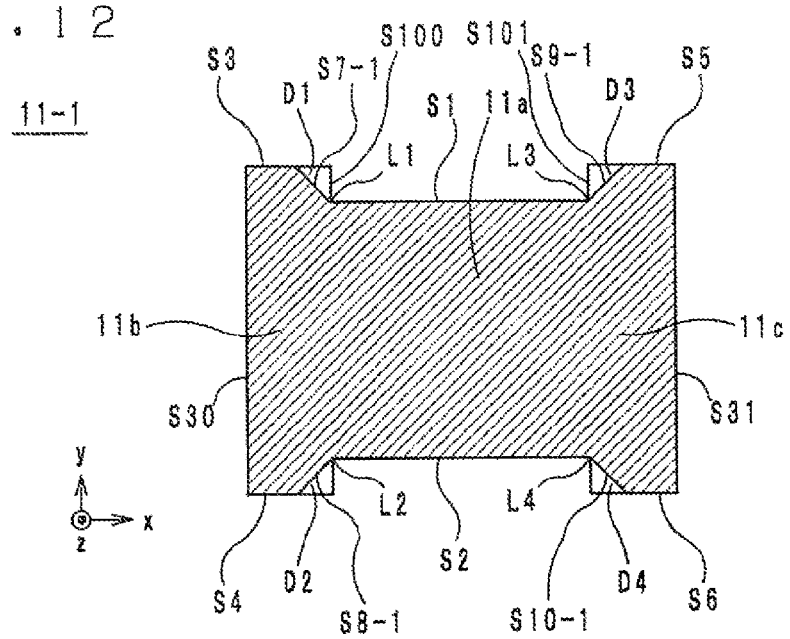
FIG. 12 is a sectional view of the core of the wire-wound electronic component shown by FIG. 11, taken along the line B-B.
Figure 13:
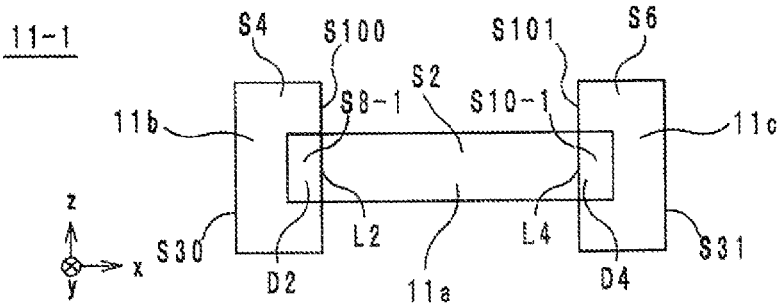
FIG. 13 is a plan view of the core of the wire-wound electronic component according to the first modification, when viewed from a negative side on the y-axis direction.

First Modification: Next, a wire-wound electronic component 10-1 according to a first exemplary modification is described with reference to the accompanying drawings. FIG. 11 is a plan view of a core 11-1 of the wire-wound electronic component 10-1 according to the first modification, when viewed from the positive side on the y-axis direction. FIG. 12 is a sectional view of the core 11-1 of the wire-wound electronic component 10-1 according to the first modification shown by FIG. 11, taken along the line B-B. FIG. 13 is a plan view of the core 11-1 of the wire-wound electronic component 10-1 according to the first modification, when viewed from the negative side on the y-axis direction.

The wire-wound electronic component 10-1 is different from the wire-wound electronic component 10 in the shapes of the connecting surfaces S7 to S10. There are no other differences between the wire wound electronic component 10 and the wire-wound electronic component 10-1, and the details of the same parts described above are not repeated in the following description. With respect to the wire-wound electronic component 10-1, male dies to press the core 11-1 are denoted by 50-1 and 60-1. Connecting surfaces are denoted by S7-1, S8-1, S9-1 and S10-1. In FIGS. 11-13 showing the core 11-1 of the wire-wound electronic component 10-1, the same parts as the parts of the core 11 of the wire-wound electronic component 10 are denoted by the same reference symbols.

As shown by FIG. 12, unlike the connecting surfaces S7 to S10, the connecting surfaces S7-1 to S10-1 are not curved surfaces and are planar surfaces. More specifically, the connecting surface S7-1 is shaped such that with increasing distance from the contact portion L1 and decreasing distance from the main surface S30 of the flange 11*b* that is opposite to the adjoining surface S100 with respect to the axial direction of the winding core portion 11*a*, that is, as it comes farther in the negative side on the x-axis direction from the contact portion L1, the distance in the y-axis direction between the connecting surface S7-1 and the end surface S3 decreases at a constant rate. The connecting surface S8-1 is shaped such that with increasing distance from the contact portion L2 and decreasing distance from the main surface S30 of the flange 11*b* that is opposite to the adjoining surface S100 with respect to the axial direction of the winding core portion 11*a*, that is, as it comes farther in the negative side on the x-axis direction from the contact portion L2, the distance in the y-axis direction between the connecting surface S8-1 and the end surface S4 decreases at a constant rate. The connecting surface S9-1 is shaped such that with increasing distance from the contact point L3 and decreasing direction from the main surface S31 of the flange 11*c* that is opposite to the adjoining surface S101 with respect to the axial direction of the winding core portion 11*a*, that is, as it comes farther in the positive side on the x-axis direction from the contact portion L3, the distance in the y-axis direction between the connecting surface S9-1 and the end surface S5 decreases at a constant rate. The connecting surface S10-1 is shaped such that with increasing distance from the contact portion L4 and decreasing distance from the main surface S31 of the flange 11*c* that is opposite to the adjoining surface S101 with respect to the axis of the winding core portion 11*a*, that is, as it comes farther in the positive side on the x-axis direction from the contact portion L4, the distance in the y-axis direction between the connecting surface S10-1 and the end surface S6 decreases at a constant rate.

In the wire-wound electronic component 10-1 of the structure as described above, the connecting surfaces S7-1 to S10-1 are planar surfaces, and the shapes of the connecting surfaces S7-1 to S10-1 are simpler than the shapes of the connecting surfaces S7 to S10. Accordingly, corresponding male dies 50-1 and 60-1 (not shown) to press the core 11-1 of the wire-wound electronic component 10-1 have simpler shapes than the male dies 50 and 60 to press the core 11 of the wire-wound electronic component 10.

Figure 14:
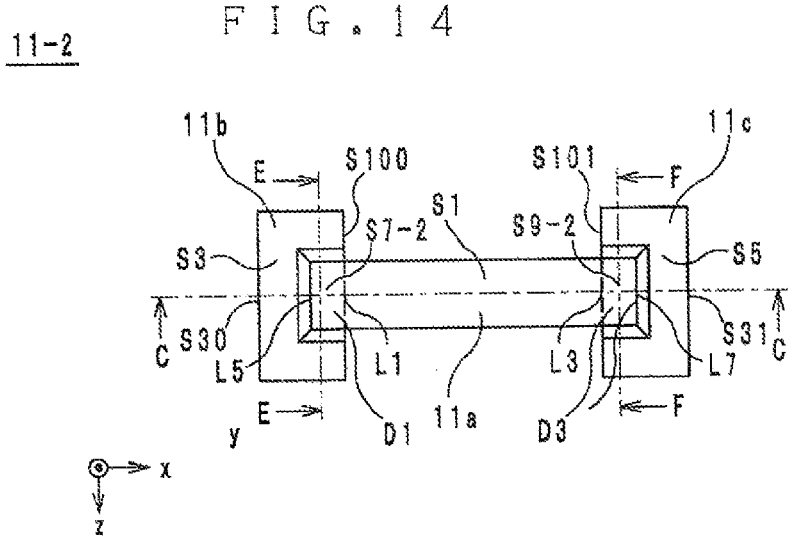
FIG. 14 is a plan view of a core of a wire-wound electronic component according to a second exemplary modification, when viewed from a positive side on the y-axis direction.
Figure 15:
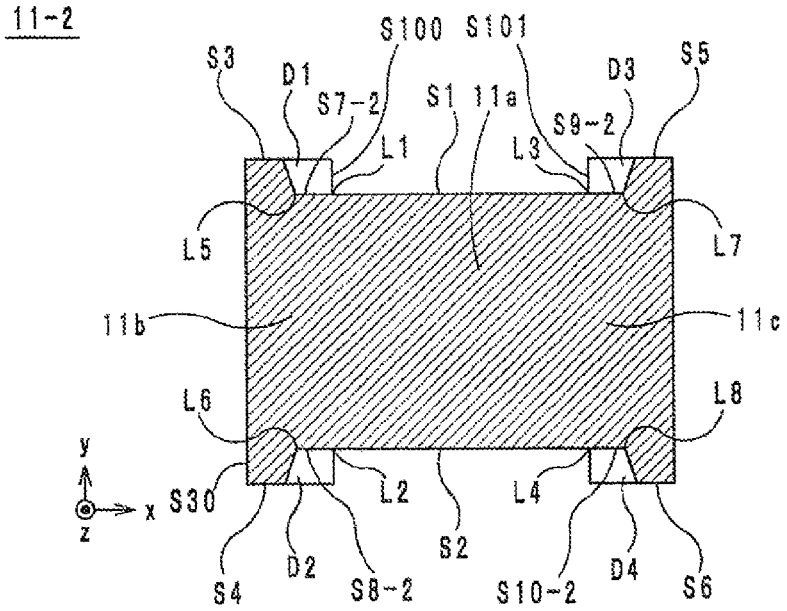
FIG. 15 is a sectional view of the core of the wire-wound electronic component shown by FIG. 14, taken along the line C-C.
Figure 16:
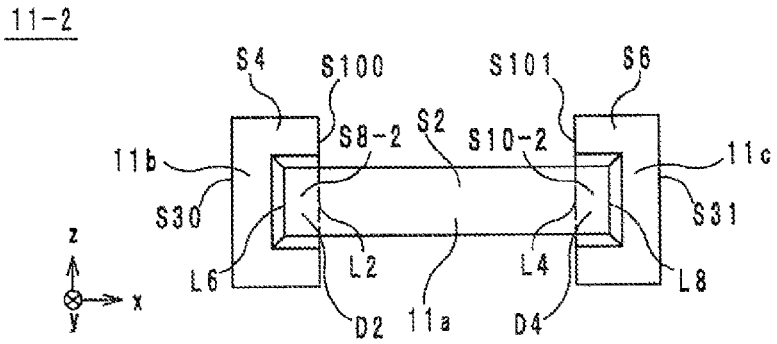
FIG. 16 is a plan view of the core of the wire-wound electronic component according to the second modification, when viewed from a negative side on the y-axis direction.
Figure 17:
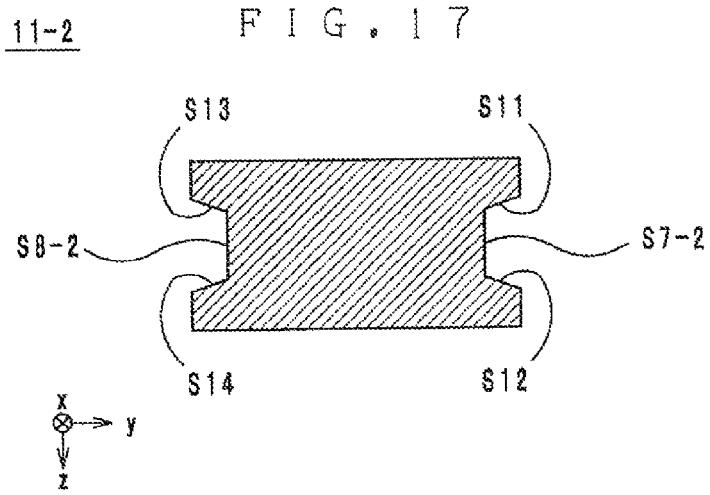
FIG. 17 is a sectional view of the core of the wire-wound electronic component according to the second modification shown by FIG. 14, taken along the line E-E.
Figure 18:
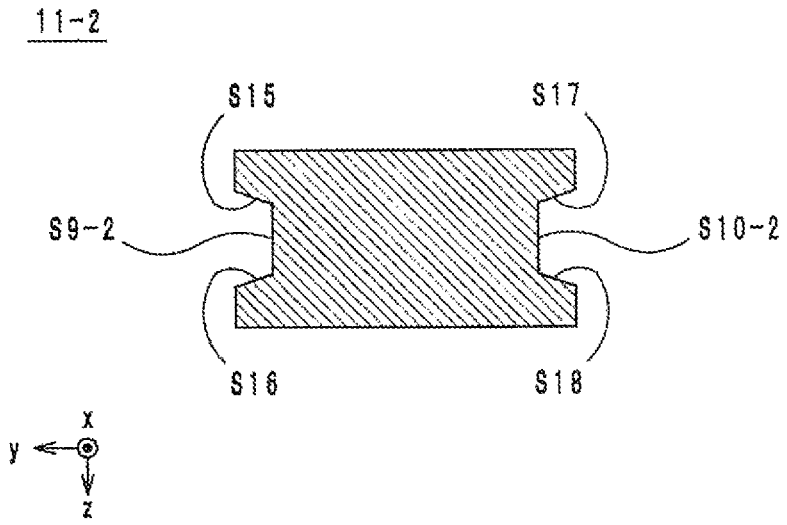
FIG. 18 is a sectional view of the core of the wire-wound electronic component according to the second modification shown by FIG. 14, taken along the line F-F.

Second Modification: Next, a wire-wound electronic component 10-2 according to a second exemplary modification is described with reference to the accompanying drawings. FIG. 14 is a plan view of a core 11-2 of a wire-wound electronic component 10-2 according to the second modification, when viewed from a positive side on the y-axis direction. FIG. 15 is a sectional view of the core 11-2 of the wire-wound electronic component 10-2 according to the second modification shown by FIG. 14, taken along the line C-C. FIG. 16 is a plan view of the core 11-2 of the wire-wound electronic component 10-2 according to the second modification, when viewed from a negative side on the y-axis direction. FIG. 17 is a sectional view of the core 11-2 of the wire-wound electronic component 10-2 according to the second modification shown by FIG. 14, taken along the line E-E. FIG. 18 is a sectional view of the core 11-2 of the wire-wound electronic component 10-2 according to the second modification shown by FIG. 14, taken along the line F-F.

The wire-wound electronic component 10-2 is different from the wire-wound electronic component 10 in the shapes of the concaves D1 to D4. There are no other differences between the wire wound electronic component 10 and the wire-wound electronic component 10-2, and the details of the same parts described above are not repeated in the following description. With respect to the wire-wound electronic component 10-2, male dies (not shown) to press the core 11-2 are denoted by 50-2 and 60-2. Connecting surfaces are denoted by S7-2, S8-2, S9-2 and S10-2. In FIGS. 14 to 18 showing the core 11-2 of the wire-wound electronic component 10-2, the same parts as the parts of the core 11 of the wire-wound electronic component 10 are denoted by the same reference symbols.

As shown in FIG. 15, the connecting surface S7-2 of the wire-wound electronic component 10-2, in an area from the contact portion L1 to an inclination start portion L5 where the connecting surface S7-2 starts inclining, is parallel to a plane including the x-axis and the y-axis (which will be referred to as an xy plane). With increasing distance from the inclination start portion L5 and decreasing distance from the main surface S30 of the flange 11*b* that is opposite to the adjoining surface S100 with respect to the axial direction of the winding core portion 11*a*, the distance in the y-axis direction between the connecting surface S7-2 and the end surface S3 decreases. The connecting surface S8-2, in an area from the contact portion L2 to an inclination start portion L6 where the connecting surface S8-2 starts inclining, is parallel to the xy plane. With increasing distance from the inclination start portion L6 and decreasing distance from the main surface S30 of the flange 11*b* that is opposite to the adjoining surface S100 with respect to the axial direction of the winding core portion 11*a*, the distance in the y-axis direction between the connecting surface S8-2 and the end surface S4 decreases. The connecting surface S9-2, in an area from the contact portion L3 to an inclination start portion L7 where the connecting surface S9-2 starts inclination, is parallel to the xy plane. With increasing distance from the inclination start portion L7 and decreasing distance from the main surface S31 of the flange 11*c* that is opposite to the adjoining surface S101 with respect to the axial direction of the winding core portion 11*a*, the distance in the y-axis direction between the connecting surface S9-2 and the end surface S5 decreases. The connecting surface S10-2, in an area from the contact portion L4 to an inclination start portion L8 where the connecting surface S10-2 starts inclining, is parallel to the xy plane. With increasing distance from the inclination start portion L8 and decreasing distance from the main surface S31 of the flange 11*c* that is opposite to the adjoining surface S101 with respect to the axial direction of the winding core portion 11*a*, the distance in the y-axis direction between the connecting surface S9-2 and the end surface S6 decreases.

In the wire-wound electronic component 10-2 of the structure as described above, as in the wire-wound electronic component 10, the core 11-2 can be prevented from having chips and cracks during molding of the core, and the winding area of the winding core portion 11*a* of the core 11-2 can be extended to the ends of the winding core portion.

In the wire-wound electronic component 10-2, as shown by FIGS. 17 and 18, all of the normal vectors of the adjoining surfaces S11 to S18, which adjoin to the connecting surfaces S7-2 to S10-2, respectively, with respect to the z-axis direction, have components in a direction in which the flanges 11*b* and 11*c* project from the winding core portion 11*a* (i.e., in the first perpendicular direction). In other words, each of the adjoining surfaces S11 to S18 is formed of surfaces visible from the y-axis direction that is the molding-die pull-away direction. Thereby, at the same time as the molding-die pull-away process starts, the pressing surfaces of the male dies corresponding to the adjoining surfaces S11 to S18 separate from the adjoining surfaces S11 through S18. Accordingly, frictions between the adjoining surfaces S11 to S18 and corresponding male dies 50-2 and 60-2 (not shown) can be suppressed. In the wire-wound electronic component 10-2, therefore, chips and cracks in the adjoining surfaces S11 to S18 as well as in the connecting surfaces S7-2 to S10-2 can be prevented.

Figure 19:
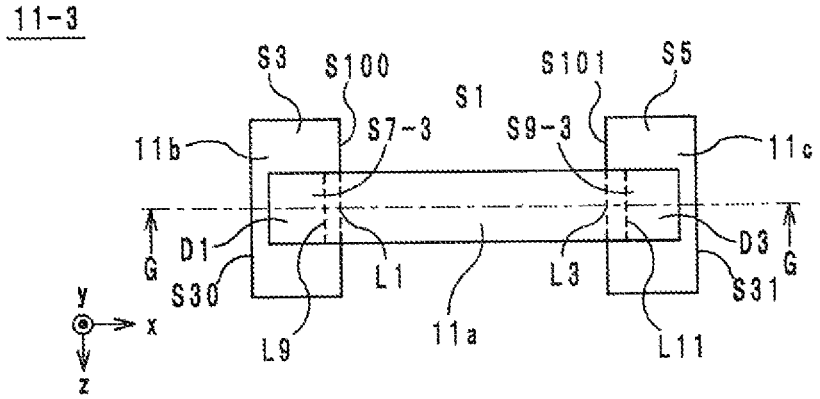
FIG. 19 is a plan view of a core of a wire-wound electronic component according to a third exemplary modification, when viewed from a positive side on the y-axis direction.
Figure 20:
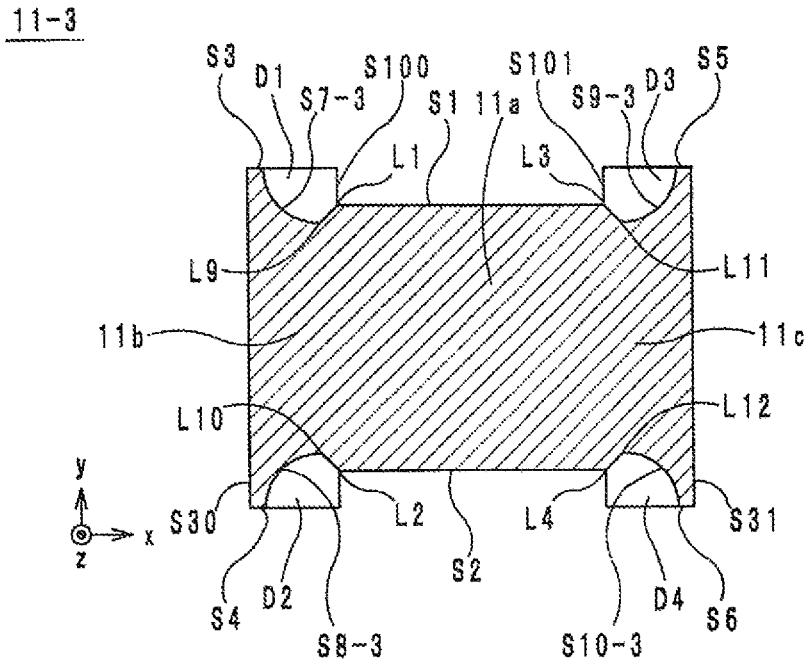
FIG. 20 is a sectional view of the core of the wire-wound electronic component according to the third modification shown by FIG. 19, taken along the line G-G.
Figure 21:
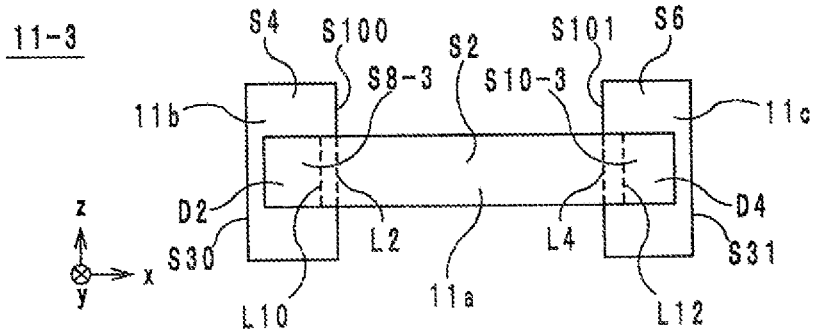
FIG. 21 is a plan view of a core of a wire-wound electronic component according to the third modification shown by FIG. 19, when viewed from a negative side on the y-axis direction.
Figure 22:
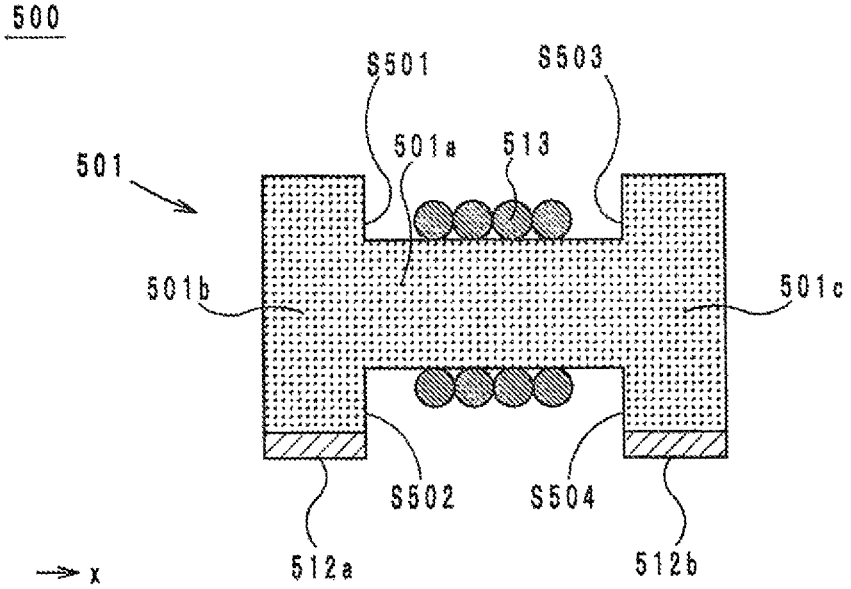
FIG. 22 Prior Art
FIG. 22 is a sectional view of a wire-wound coil component disclosed by Patent Document 1.
Figure 23:
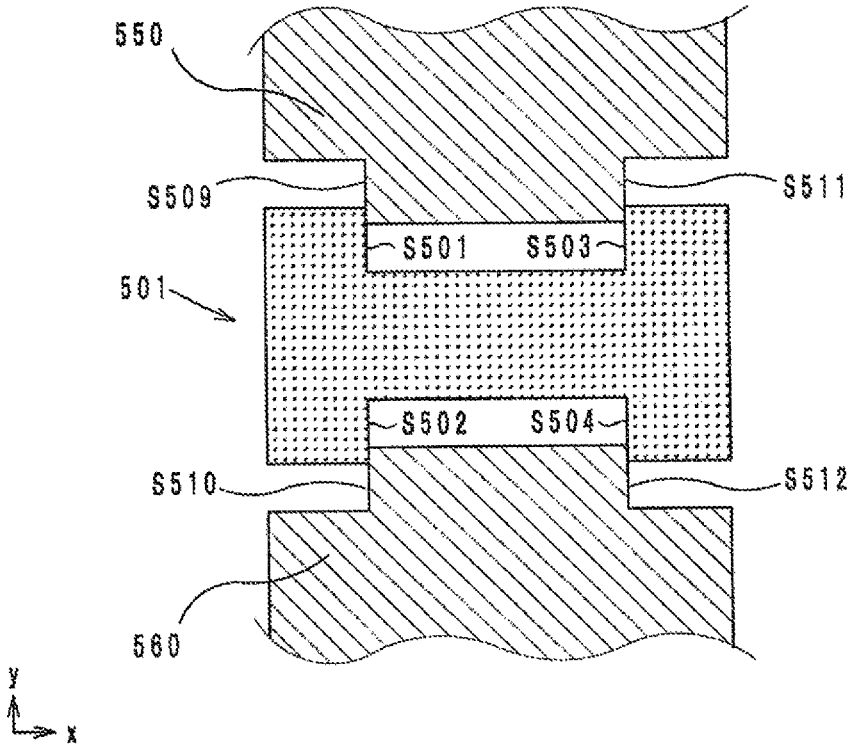
FIG. 23 Prior Art
FIG. 23 is a sectional view of the wire-wound coil component disclosed by Patent Document 1 during a production process.

Third Modification: Next, a wire-wound electronic component 10-3 according to a third exemplary modification is described with reference to the accompanying drawings. FIG. 19 is a plan view of a core 11-3 of the wire-wound electronic component 10-3 according to the third modification, when viewed from a positive side on the y-axis direction. FIG. 20 is a sectional view of the core 11-3 of the wire-wound electronic component 10-3 according to the third modification shown by FIG. 19, taken along the line G-G. FIG. 21 is a plan view of the core 10-3 of the wire-wound electronic component 11-3 according to the third modification shown by FIG. 19, when viewed from a negative side on the y-axis direction.

The wire-wound electronic component 10-3 is different from the wire-wound electronic component 10 in the shapes of the connecting surfaces S7 to S10. There are no other differences between the wire wound electronic component 10 and the wire-wound electronic component 10-3, and the details of the same parts described above are not repeated in the following description. Connecting surfaces of the wire-wound electronic component 10-3 are denoted by S7-3, S8-3, S9-3 and S10-3. In FIGS. 19 to 21 showing the wire-wound electronic component 10-3, the same parts as the parts of the core 11 of the wire-wound electronic component 10 are denoted by the same reference symbols.

In a wire-wound electronic component according to the present disclosure, the connecting surfaces of the core may include a concave and a concavity as the connecting surfaces S7-3 to S10-3 shown in FIG. 20. More specifically, with increasing distance from the contact portion L1 and decreasing distance from a specified portion L9 in the connecting surface S7-3, the distance in the y-axis direction between the connecting surface S7-3 and the end surface S3 increases. With increasing distance from the specified portion L9 and decreasing distance from the main surface S30 of the flange 11*b* that is opposite to the adjoining surface S100 with respect to the axial direction of the winding core portion 11*a*, the distance in the y-axis direction between the connecting surface S7-3 and the end surface S3 decreases. With increasing distance from the contact portion L2 and decreasing distance from a specified portion L10 in the connecting surface S8-3, the distance in the y-axis direction between the connecting surface S8-3 and the end surface S4 increases. With increasing distance from the specified portion L10 and decreasing distance from the main surface S30 of the flange 11*b* that is opposite to the adjoining surface S100 with respect to the axial direction of the winding core portion 11*a*, the distance in the y-axis direction between the connecting surface S8-3 and the end surface S4 decreases. With increasing distance from the contact portion L3 and decreasing distance from a specified portion L11 in the connecting surface S9-3, the distance in the y-axis direction between the connecting surface S9-3 and the end surface S5 increases. With increasing distance from the specified portion L11 and decreasing distance from the main surface S31 of the flange 11*c* that is opposite to the adjoining surface S101 with respect to the axial direction of the winding core portion 11*a*, the distance in the y-axis direction between the connecting surface S9-3 and the end surface S5 decreases. With increasing distance from the contact portion L4 and decreasing distance from a specified portion L12 in the connecting surface S10-3, the distance in the y-axis direction between the connecting surface S10-3 and the end surface S6 increases. With increasing distance from the specified portion L12 and decreasing distance from the main surface S31 of the flange 11*c* that is opposite to the adjoining surface S101 with respect to the axial direction of the winding core portion 11*a*, the distance in the y-axis direction between the connecting surface S10-3 and the end surface S6 decreases.

In the wire-wound electronic component 10-3 of the structure as described, as in the wire-wound electronic component 10, the core 11-3 can be prevented from having chips and cracks during molding of the core, and the winding area of the winding core portion 11*a* of the core 11-3 can be extended to the ends of the winding core portion.

Other Embodiments: Wire-wound electronic components, cores for wire-wound electronic components and methods for manufacturing cores for wire-wound electronic components according to the present disclosure are not limited to the wire wound electronic components 10, 10-1, 10-2 and 10-3, the cores 11, 11-1, 11-2 and 11-3 of the wire-wound electronic components, and the manufacturing methods of the cores of the wire-wound electronic components according to the exemplary embodiments described above, and various changes and modifications may be made within the scope of the present disclosure. For example, the electrodes of an embodiment of a wire-wound electronic component according to the present disclosure may be disposed on surfaces of the flanges, either in the positive side on the z-direction, in the positive side on the y-axis direction or in the negative side on the y-axis direction, or alternatively on side surfaces of the flanges on the x-axis direction.

Industrial Applicability As described above, embodiments according to the present disclosure are advantageously applicable to wire-wound electronic components, cores for wire-wound electronic components and methods for manufacturing cores for wire-wound electronic components. Embodiments according to the present disclosure are especially advantageous in that the core can be prevented from being chipped and cracked during molding thereof and in that the winding area where the wiring wire can be wound around the winding core portion can be extended to the ends of the winding core portion.

That which is claimed is:

1. A core for a wire-wound electronic component, the core comprising:

a winding core portion around which a winding wire is to be wound;

flanges provided at respective ends of the winding core portion, the flanges projecting from the winding core portion in directions perpendicular to an axial direction of the winding core portion; and concaves at respective corners, each corner formed of an adjoining surface of one of the flanges that adjoins to the winding core portion and an end surface of the flange that is located at an end in a first perpendicular direction, which is one of the projecting directions of the flanges;

wherein at least part of inner periphery of each of the concaves includes a connecting surface that connects a contact portion where one of the flanges contact with the winding core portion to one of the end surfaces, all normal vectors of the connecting surfaces have components in the first perpendicular direction, and the flanges extend at least partially over the concaves.

2. The core for a wire-wound electronic component according to claim 1, wherein the first perpendicular direction is a molding-die pull-away direction in which a molding die used for molding of the core for a wire-wound electronic component is pulled away.

3. The core for a wire-wound electronic component according to claim 1, wherein a second perpendicular direction is a direction perpendicular to the first perpendicular direction and the axial direction; and wherein a width in the second perpendicular direction of each of the connecting surfaces is equal to a width in the second perpendicular direction of the winding core portion, when viewed from the first perpendicular direction.

4. The core for a wire-wound electronic component according to claim 1, wherein each of the connecting surfaces is shaped such that with increasing distances from the respective adjoining surface of one of the flanges and decreasing distances to a main surface of the flange that is opposite to the adjoining surface of the flanges and is situated in the axial direction of the winding core portion, distances in the first perpendicular direction between the connecting surface and the respective end surface decreases.

5. The core for a wire-wound electronic component according to claim 1, wherein electrodes are provided on end surfaces, which are located at ends in the second perpendicular direction, of the flanges.

6. The core for a wire-wound electronic component according to claim 1, wherein each of the connecting surfaces is arc shaped.

7. A core for a wire-wound electronic component, the core comprising:

a winding core portion around which a winding wire is to be wound; and flanges provided at respective ends of the winding core portion, the flanges projecting from the winding core portion in a direction perpendicular to an axial direction of the winding core portion; and concaves at respective corners, each corner formed of an adjoining surface of one of the flanges that adjoin to the winding core portion and an end surface of the flanges located in the projecting direction of the flanges;

wherein inner peripheries of each of the concaves includes a respective connecting surface that connects a contact portion where one of the flanges contact with the winding core portion to one of the end surfaces, the connecting surfaces are formed of visible surfaces as viewed from a specified direction perpendicular to the axial direction, and the flanges extend at least partially over the concaves.

8. The core for a wire-wound electronic component according to claim 7, wherein the specified direction is a molding-die pull-away direction in which a molding die used for molding of the core for a wire-wound electronic component is pulled away.

9. The core for a wire-wound electronic component according to claim 7, wherein a width in a perpendicular direction, which is perpendicular to the specified direction and the axial direction of the connecting surfaces, of each of the connecting surfaces is equal to a width in the perpendicular direction of the winding core portion, when viewed from the specified direction.

10. The core for a wire-wound electronic component according to claim 7, wherein each of the connecting surfaces is shaped such that with increasing distances from the respective adjoining surface of one of the flanges and decreasing distances to a main surface of the flanges that is opposite to the adjoining surface of the flange and is situated in the axial direction of the winding core portion, distances in the first perpendicular direction between the connecting surface and the respective end surfaces decreases.

11. The core for a wire-wound electronic component according to claim 7, further comprising:

electrodes provided on first end surfaces of the flanges.

12. The core for a wire-wound electronic component according to claim 7, wherein each of the connecting surfaces is arc shaped.

13. A wire-wound electronic component comprising:

the core for a wire-wound electronic component according to claim 1; and a winding wire that is wound around the winding core portion of the core.

14. A wire-wound electronic component comprising:

the core for a wire-wound electronic component according to claim 7; and a winding wire that is wound around the winding core portion of the core.

* * * * *